US009048547B2

(12) United States Patent
Zhang et al.

(10) Patent No.: US 9,048,547 B2
(45) Date of Patent: Jun. 2, 2015

(54) AIR LOOP ANTENNA FOR SHARED AM/FM

(71) Applicant: Silicon Laboratories Inc., Austin, TX (US)

(72) Inventors: Ligang Zhang, Shenzhen (CN); Chengzhou Lin, Shenzhen (CN)

(73) Assignee: Silicon Laboratories Inc., Austin, TX (US)

( * ) Notice: Subject to any disclaimer, the term of this patent is extended or adjusted under 35 U.S.C. 154(b) by 190 days.

(21) Appl. No.: 13/914,949

(22) Filed: Jun. 11, 2013

(65) Prior Publication Data

US 2013/0271340 A1 Oct. 17, 2013

Related U.S. Application Data

(63) Continuation of application No. PCT/CN2010/002204, filed on Dec. 30, 2010.

(51) Int. Cl.
*H01Q 7/00* (2006.01)
*H01Q 1/50* (2006.01)

(52) U.S. Cl.
CPC ... *H01Q 1/50* (2013.01); *H01Q 7/00* (2013.01)

(58) Field of Classification Search
CPC ..... H01Q 1/50; H01Q 7/00
See application file for complete search history.

(56) References Cited

U.S. PATENT DOCUMENTS

| | | | | |
|---|---|---|---|---|
| 5,134,419 | A | 7/1992 | Egashira | |
| 5,239,304 | A | 8/1993 | Egashira | |
| 5,239,699 | A * | 8/1993 | Ecklund | 455/142 |
| 5,438,698 | A | 8/1995 | Burton et al. | |
| 5,937,337 | A * | 8/1999 | Marrah et al. | 455/142 |
| 6,456,832 | B1 * | 9/2002 | Yanagisawa et al. | 455/193.1 |
| 7,239,281 | B2 | 7/2007 | Lu | |
| 7,340,285 | B2 | 3/2008 | Yoshino | |
| 2008/0224568 | A1 * | 9/2008 | Kvisteroy et al. | 310/336 |
| 2010/0035468 | A1 * | 2/2010 | Perrot et al. | 439/607.01 |
| 2010/0124883 | A1 | 5/2010 | Hu et al. | |
| 2010/0136936 | A1 | 6/2010 | Jiang | |
| 2010/0144295 | A1 * | 6/2010 | Kroeger et al. | 455/193.1 |

FOREIGN PATENT DOCUMENTS

| | | |
|---|---|---|
| CN | 1698236 | 11/2005 |
| CN | 101588186 | 11/2009 |
| JP | 57058402 | 4/1982 |

OTHER PUBLICATIONS

Search Report, PCT/CN2010/002204; Oct. 13, 2011, 3 pgs.
Silicon Laboratories, "Broadcast AM/FM./SW/LW Radio Receiver", SI4734/35-B20, 2008, 38 pgs.

* cited by examiner

*Primary Examiner* — Trinh Dinh
(74) *Attorney, Agent, or Firm* — Egan, Peterman & Enders LLP.

(57) ABSTRACT

Systems and methods are disclosed for shared AM/FM air loop antennas that may be advantageously implemented to provide a AM/FM receiver system with a single common air loop antenna for receiving both AM and FM channels, thus eliminating the need for additional materials and electronics associated with provision of a separate FM pigtail antenna and FM antenna jack for connection of same. The shared AM/FM air loop antennas may be connected to a radio device having antenna connections.

26 Claims, 8 Drawing Sheets

AIR LOOP ANTENNA FOR SHARED AM/FM

CROSS REFERENCE TO RELATED APPLICATIONS

The present application is a continuation of pending International patent application PCT/CN2010/002204 filed on Dec. 30, 2010, the content of which is incorporated herein by reference in its entirety.

TECHNICAL FIELD OF THE INVENTION

This invention relates to radio frequency communications and, more particularly, to radio frequency receive operations in devices.

BACKGROUND

Consumer electronics systems exist that receive broadcast channels in both the AM broadcast band (about 520 to about 1710 KHz) and the FM broadcast band (about 87.5 MHz to about 108 MHz in the United States). Examples of such systems include miniature high fidelity systems, home theater systems, etc. Such systems are typically provided with separate external AM and FM antennas to reduce noise interference from internal electronic system components, i.e., an external pigtail antenna provided for FM reception and an external air loop antenna provided for AM reception. Use of external antennas also allows for antenna orientation that is independent of the placement of the radio device.

SUMMARY OF THE INVENTION

Disclosed herein are shared AM/FM air loop antennas and methods associated therewith. The disclosed antenna and methods may be advantageously implemented to provide a AM/FM receiver system (e.g., home theater system, boom box, miniature high fidelity system, desktop radio, etc.) with a single common air loop antenna for receiving both AM and FM channels, thus eliminating the need for additional materials and electronics associated with provision of a separate FM pigtail antenna and FM antenna jack for connection of same.

In one embodiment, a shared AM/FM air loop antenna may be coupled through a transformer to an AM tuner input of the AM/FM receiver system. The transformer may be provided as part of the receiver system (e.g., on a PCB inside a chassis enclosure of the receiver system), or may alternatively be provided separate from the receiver system and coupled to the air loop antenna as part of an integrated assembly that includes both transformer and air loop antenna. In either case, an extension wire may be employed to couple the shared AM/FM air loop antenna to internal AM and FM receiver circuitry provided within the receiver system, in one embodiment via a single common AM/FM antenna connector (e.g., antenna jack) of the receiver system. In one embodiment, FM blocker elements (e.g., in the form of ferrite beads or other low pass, band pass or band reject filter elements such as inductors, LC band pass or band reject filters, RC band pass or band reject filters, etc.) may be strategically coupled between the shared antenna and selected portions of the AM and FM receiver circuitry within the receiver system for the purpose of blocking dissipation of FM signals.

In one respect, disclosed herein is shared AM/FM antenna circuitry configured for coupling to radio circuitry, including: an air loop antenna element formed between first and second antenna element nodes, the air loop antenna element being configured to receive AM channels within an AM broadcast band; a first conductor segment coupled to the first node of the air loop antenna element with the first node being between the air loop antenna element and the first conductor segment; and a second conductor segment coupled to the second node of the air loop antenna element with the second node being between the air loop antenna element and the second conductor segment. At least one of the first and second conductor segments may be configured to receive FM channels within an FM broadcast band; at least one of the first and second conductor segments may be coupled between the first or second node of the air loop antenna element and an AM signal path, the AM signal path being configured for coupling at a third node to provide the received AM broadcast channels to an AM signal input of the radio circuitry; and at least one of the first and second conductor segments may be coupled between the first or second node of the air loop antenna element and a FM signal path, the FM signal path being configured for coupling at a fourth node to provide the received FM broadcast channels to an FM signal input of the radio circuitry. The AM signal path may be further configured to at least partially block the received FM broadcast band channels and to at least partially pass the received AM broadcast band channels to the AM signal input of the radio circuitry, and the FM signal path may be further configured to at least partially pass the received FM broadcast band channels to the FM signal input of the radio circuitry.

In another respect, disclosed herein is an AM/FM radio receiver system, including a radio device and a shared AM/FM loop antenna coupled to a radio device. The radio device may include: antenna connections; AM/FM radio circuitry including tuner circuitry, the tuner circuitry having an AM signal input and a FM signal input, the AM signal input configured to receive AM broadcast channels and the FM signal input configured to receive FM broadcast channels; an AM signal path coupled between at least one of the antenna connections and the AM signal input; and an FM signal path coupled between at least one of the antenna connections and the FM signal input. The shared AM/FM loop antenna may be coupled to the antenna connections of the radio device, and may include: an air loop antenna element formed between first and second antenna element nodes, the air loop antenna element being configured to receive AM channels within an AM broadcast band; a first conductor segment coupled to the first node of the air loop antenna element with the first node being between the air loop antenna element and the first conductor segment; and a second conductor segment coupled to the second node of the air loop antenna element with the second node being between the air loop antenna element and the second conductor segment. At least one of the first and second conductor segments may be configured to receive FM channels within an FM broadcast band; and at least one of the first and second conductor segments being coupled between the first or second node of the air loop antenna element and the AM signal path by one of the radio device antenna connections; at least one of the first and second conductor segments being coupled between the first or second node of the air loop antenna element and the FM signal path by one of the radio device antenna connections; the AM signal path being further configured to at least partially block the received FM broadcast band channels and to at least partially pass the received AM broadcast band channels to the AM signal input of the radio circuitry; and the FM signal path being further configured to at least partially pass the received FM broadcast band channels to the FM signal input of the radio circuitry.

In another respect, disclosed herein is a method for receiving AM and FM radio frequency (RF) signals with an air loop antenna, including providing shared AM/FM antenna circuitry that includes: an air loop antenna element formed between first and second antenna element nodes; a first conductor segment coupled to the first node of the air loop antenna element with the first node being between the air loop antenna element and the first conductor segment; and a second conductor segment coupled to the second node of the air loop antenna element with the second node being between the air loop antenna element and the second conductor segment. The method may further include: receiving AM broadcast band signals within the air loop antenna element and coupling the received AM signals through at least one of the first and second conductor segments to an AM signal path of a radio device; receiving FM broadcast band signals within at least one of the first and second conductor segments and coupling the received FM signals to an FM signal path of a radio device; at least partially passing the received AM broadcast band channels through the AM signal path to an AM signal input of radio circuitry, and at least partially blocking the received FM signals in the AM signal path from the AM signal input; at least partially passing the received FM signals through the FM signal path to an FM signal input of the radio circuitry; and tuning the received AM and FM signals in the radio circuitry.

DESCRIPTION OF THE DRAWINGS

It is noted that the appended drawings illustrate only example embodiments of the invention and are, therefore, not to be considered limiting of its scope, for the invention may admit to other equally effective embodiments.

DETAILED DESCRIPTION OF THE INVENTION

Figure 1A:
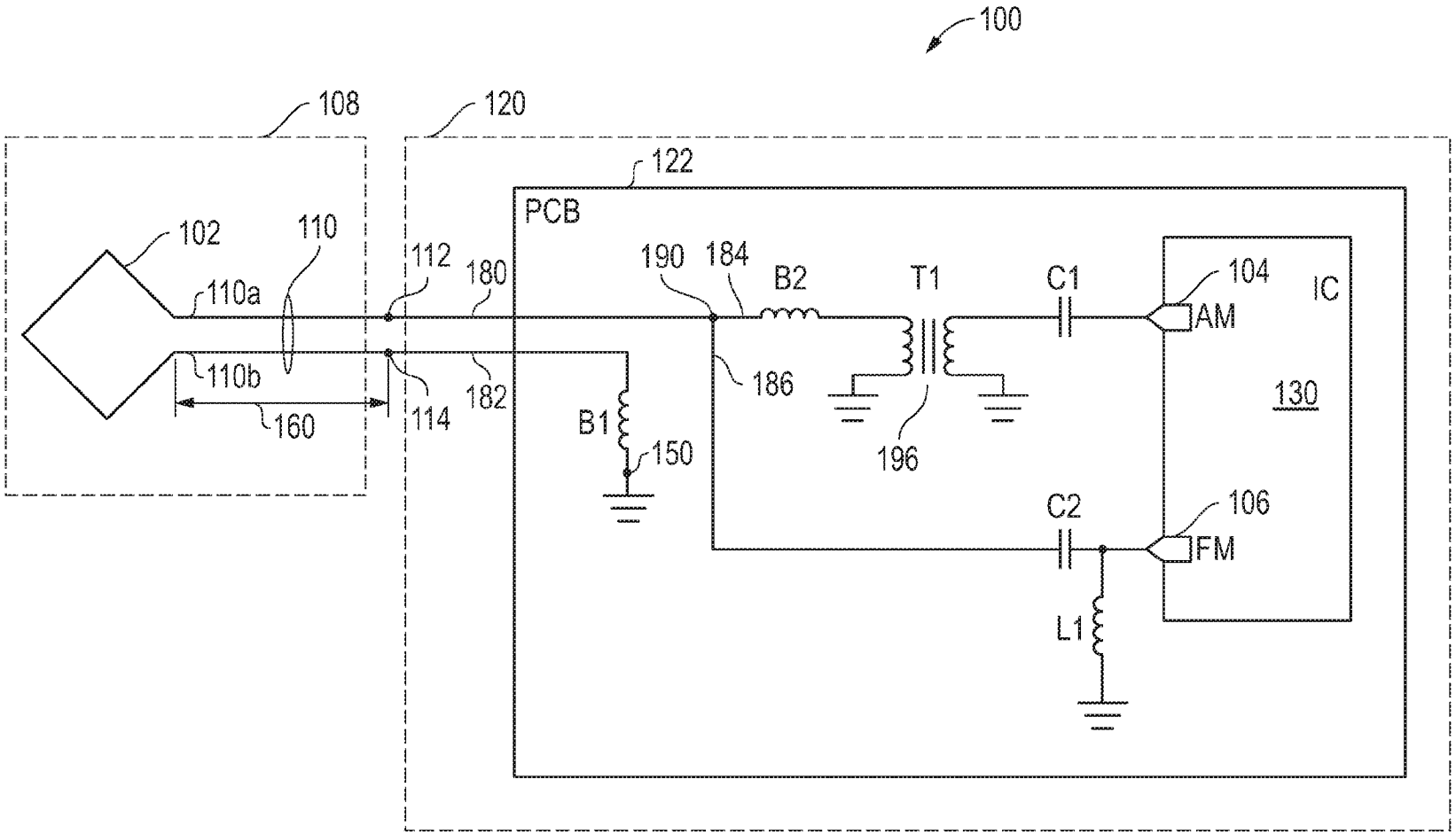
FIG. 1A illustrates a shared AM/FM loop antenna radio receiver system according to one exemplary embodiment.

FIG. 1A illustrates a shared AM/FM loop antenna radio receiver system 100 as it may be configured according to one exemplary embodiment. As shown, system 100 includes an air loop antenna element 102 that is coupled to an AM/FM radio device 120 by dual antenna extension connector segments 110*a* and 110*b* (e.g., wires or other suitable conductors) that may be, for example, provided in the form of a twisted pair connector or in other suitable form. In one exemplary embodiment, air loop antenna element 102 and dual antenna extension connectors 110 may be formed of a single continuous wire or other conductor. Together, air loop antenna element 102 and dual antenna extension connectors 110 form a loop antenna 103.

As depicted in FIG. 1A, AM/FM radio device 120 includes a printed circuit board (PCB) 122 that includes a radio integrated circuit (IC) 130 coupled thereon. The PCB 122 is located within radio device 120, and radio device 120 may be configured to output audio signals demodulated from AM and FM radio signals received and tuned by the radio IC 130. Particular examples of suitable radio IC's for use as radio IC 130 include, but are not limited to, Si473x series Broadcast AM/FM Radio Receiver ICs (e.g., Si4730, Si4731, Si 4734, Si 4735, Si 4736, Si 4737, Si 4738, Si 4739, Si474x, Si475x, Si476x, Si4830, Si4831, Si4834, Si4835) available from Silicon Laboratories of Austin, Tex. Although AM/FM radio device 120 is shown provided with a radio integrated circuit (IC) 130, it will be understood that a shared AM/FM loop antenna radio receiver system 100 may be implemented using any other type of digital and/or analog radio circuitry (including non-integrated discrete circuitry and highly integrated combo solutions) that is suitable for receiving, tuning and/or demodulating respective AM and FM signals may be employed.

In the embodiments disclosed herein, an air loop antenna element 102 may be formed by one or more wire loops or turns, e.g., from about 5 to about 7 turns (or alternatively from about 5 to about 12 turns), or any other number of turns suitable or desired for AM signal reception. As shown, antenna extension connector segments 110*a* and 110*b* of loop antenna 103 may be removably coupled as shown to AM/FM radio device 120 by external antenna connection points 112 and 114 of device 120, respectively. Although connector segments 110*a* and 110*b* may be removably coupled to connection points 112 and 114 (e.g., by mating separable wire connectors), it is also possible that connector segments 110*a* and 110*b* may be permanently coupled to connection points 112 and 114. In the configuration of this embodiment, both of antenna extension connector segments 110*a* and 110*b* may be configured to function as an FM antenna element. In one embodiment, the length 160 of each of antenna extension connector segments 110 may be from about 0.75 meters to about 1.5 meters in length (or alternatively from about 0.75 meters to about 1.75 meters in length), although any other connector length may be employed that is suitable for receiving FM broadcast channels in a manner as will be described further herein. In one exemplary embodiment, air loop antenna element 102 and extension connectors 110 may be included together as part of a single piece loop antenna 103 that is separable from AM/FM radio device 120 at external connection points 112/114 (e.g., an antenna connector connector).

As further shown in FIG. 1A, external antenna connection points 112 and 114 of radio device 120 couple to shared AM/FM signal path 180 and ground path 182 of radio device 120, respectively. Shared AM/FM signal path 180 is in turn coupled at node 190 to provide received RF signals to separate independent AM and FM signal paths 184 and 186, which are each provided on PCB 122 of system 100. In particular, AM signal path 184 is coupled to AM signal input pin 104 of integrated circuit (IC) 130, and FM signal path 186 is coupled to FM signal input pin 106 of IC 130. As shown, AM signal path 184 includes a FM blocker B2 in series with a transformer (T1) 196 (e.g., a TG-UTB01527S available from UMEC, Taiwan or a SL9x5x4MWTF available from JiaXin Electronics in Guangzhou, Guangdong Province, China) and AC coupling capacitor C1 (e.g., 0.47 μF) provided between node 190 and AM signal input pin 104. FM signal path 186 includes AC coupling capacitor C2 (e.g., 100 pF) and is coupled between node 190 and FM signal input pin 106. In operation, the AM reception performance of the air loop antenna element 102 may be optionally improved by the transformer (T1) 196.

Still referring to FIG. 1A, FM signal path 186 may be coupled to ground between capacitor C2 and FM signal input pin 106 as shown, with an inductor L1 provided therebetween. Inductance of inductor L1 may be selected (e.g., 270 nH) to resonate with the total capacitance at node 106 in order to increase FM signal input pin 106 impedance and share of received voltage from antenna 102. As further shown in FIG. 1A, ground path 182 of radio device 120 includes another FM blocker B1 adjacent ground node 150. As will be described further herein, FM blockers B1 and B2 may be so provided to selectively block dissipation of FM signals in a manner that allows both antenna extension connectors 110 to function as a FM antenna while in the same configuration that allows air loop antenna element 102 to function as an AM antenna. In this embodiment, air loop antenna 103 is thus configured and may be used for shared (e.g., simultaneous and/or alternate) reception of AM and FM band broadcast channels. Moreover, the described circuitry provided within AM/FM radio device 120 advantageously allows a conventional AM air loop antenna to also function as an FM antenna without the need for separate FM antenna circuitry and/or assembly. However, it will be understood that in alternative embodiments, one or both of FM blockers B1 and B2 may be alternatively placed elsewhere within the AM and FM signal paths from air loop antenna element 102 and antenna extension connectors 110, e.g., FM blockers B1 and B2 may be provided (together with node 190 and pin output) as integrated component/s of an integrated antenna assembly rather than within radio device 120.

In operation, air loop antenna element 102 of shared AM/FM loop antenna radio receiver system 100 receives and provides AM signals to AM signal input pin 104 via AM signal path 184 which includes AC coupling capacitor C1 and transformer (T1) 196, the latter of which is needed to improve AM reception performance of the air loop antenna element 102. At the same time, at least one of antenna extension connectors 110 receives and provides FM signals to FM signal input pin 106 via FM signal path 186 and AC coupling capacitor C2.

In the illustrated embodiment of FIG. 1A, AM signal reception by AM signal input pin 104 is substantially not affected by presence of FM blocker element B2 in AM signal path 184. In this regard, FM blocker element B2 may be selected to have a relatively low impedance in the AM broadcast band (e.g., signals with frequencies of from about 520 to about 1710 KHz in the United States (medium wave AM band), signals with frequencies of from about 148.5 to about 283.5 in Europe and some other countries (long wave AM band), or other AM frequency range that is relatively low compared to FM frequency broadcast band ranges such as 1.711 MHz-30.0 MHz shortwave AM band) so as to substantially pass received AM broadcast band signals to AM signal input pin 104. At the same time, FM blocker element B2 may be selected to have a relatively high impedance in a relatively higher frequency FM broadcast band/s (e.g., signals with frequencies of from about 87.5 MHz to about 108 MHz in the United States, signals with frequencies of from about 76 to 90 MHz in Japan, signals with frequencies of from about 65 to 74.5 MHz in the ORIT band, signals with frequencies of from about 65 MHz to about 108 MHz, or other FM frequency range that is relatively high compared to AM frequency broadcast band ranges) to block or substantially block the received FM signals from going into AM signal input pin 104. Similarly, FM blocker element B1 may also be selected to have a relatively high impedance in a FM broadcast band/s. It will be understood that FM blocker elements described herein may also block other relatively higher frequency broadcast band/s, for example, such as weather band (162.400 MHz-162.550 MHz) to allow reception thereof with AM band channels.

It will be understood that in other embodiments, FM blocker elements B1 and B2 need not be selected to have an impedance high enough to block or to substantially block received FM signals. In such an alternative embodiment, FM blocker element B1 may be selected to have sufficient impedance to only partially block received FM signals, and FM blocker element B2 may be selected to have sufficient impedance to only partially block received FM signals while at least partially passing received AM broadcast band signals, in a manner that provides suitable transmission of AM broadcast band signals to AM signal input pin 104 via AM signal path 184 and suitable transmission of FM broadcast signals to FM signal input pin 106 via FM signal path 186 to fit the needs or requirements of a given application. In this regard, FM band impedance of FM blocker elements B1 and/or B2 may be selected as desired or needed to provide adequate AM and FM signal strength to fit the requirements of a given radio circuitry configuration (e.g., IC 130 or other suitable radio circuitry). It will also be understood that although FM blocker element B2 is selected to at least partially pass received AM signals, FM blocker element B1 may partially or completely block both received AM and FM signals.

In one embodiment, each of FM blocker B1 and B2 may be a ferrite bead exhibiting an impedance of about 2.5 k Ohm at 100 MHz or higher impedance, although it will be understood that any other type of ferrite beads that produce suitably high impedance in frequencies of the selected FM broadcast band/s may be alternatively employed. One example of suitable ferrite beads is 2.5 k Ohm @100 MHz available from Sunlord. Other types of FM blocker circuit components may also be employed for elements B1 and/or B2. For example, any other type of circuit component or combination of circuit components may be employed that is suitable for functioning as a FM blocker element B2 to selectively pass relatively lower frequency AM signals to AM signal input pin 104 while substantially blocking relatively higher frequency FM signals from AM signal input pin 104. Similarly, any other type of circuit component or combination of circuit components may be employed that is suitable for functioning as a FM blocker element B1 to substantially block relatively higher frequency FM signals from the DC path to ground. Examples of suitable alternative types of FM blocker components (and combinations thereof) for elements B1 and B2 (and any other of the FM blocker components B3-B7 further described herein) include, but are not limited to, low pass, band pass, or band reject filter components such as inductors having suitable parasitic capacitance with low pass, band pass, or band reject filtering characteristics, inductor and capacitor in parallel with suitable low pass, band pass, or band reject filtering characteristics, combinations thereof, etc. Further, it will be understood that the particular given component values of FM blockers (B1-B7), C1, C2 and L1 described herein are exemplary only and that electrical specifications of such components may be selected as needed or desired to fit the requirements of a particular application. Additionally, other circuit components may be present in other embodiments of the disclosed methods and systems.

Figure 1B:
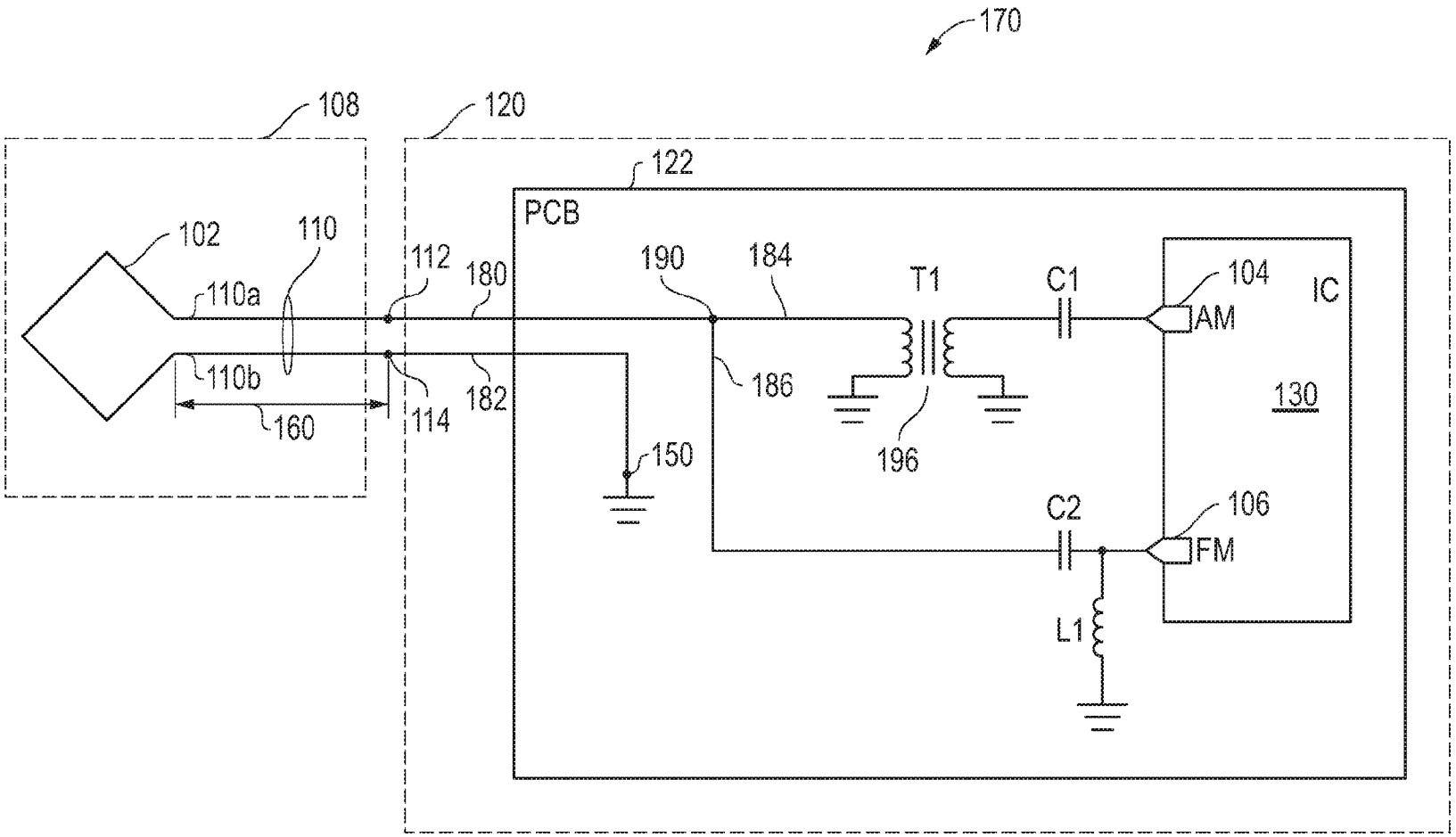
FIG. 1B illustrates a shared AM/FM loop antenna radio receiver system according to one exemplary embodiment.

FIG. 1B illustrates an alternative embodiment of shared AM/FM loop antenna radio receiver system 170 that does not include FM blocker elements B1 and B2. Otherwise, the receiver system 170 is configured substantially the same as the embodiment of FIG. 1A. In this particular embodiment, the FM impedance characteristics (e.g., as a function of conductor length, material and/or diameter) of AM signal path 184 may be configured to at least partially impede FM broadcast band signals and to at least partially pass AM broadcast band signals, and the FM impedance characteristics of ground path 182, in a manner that provides suitable transmission of AM broadcast band signals to AM signal input pin 104 via AM signal path 184 and suitable transmission of FM broadcast signals to FM signal input pin 106 via FM signal path 186 to fit the needs or requirements of a given application, e.g., to provide adequate AM and FM signal strength to fit the requirements of a given radio circuitry configuration.

Figure 2:
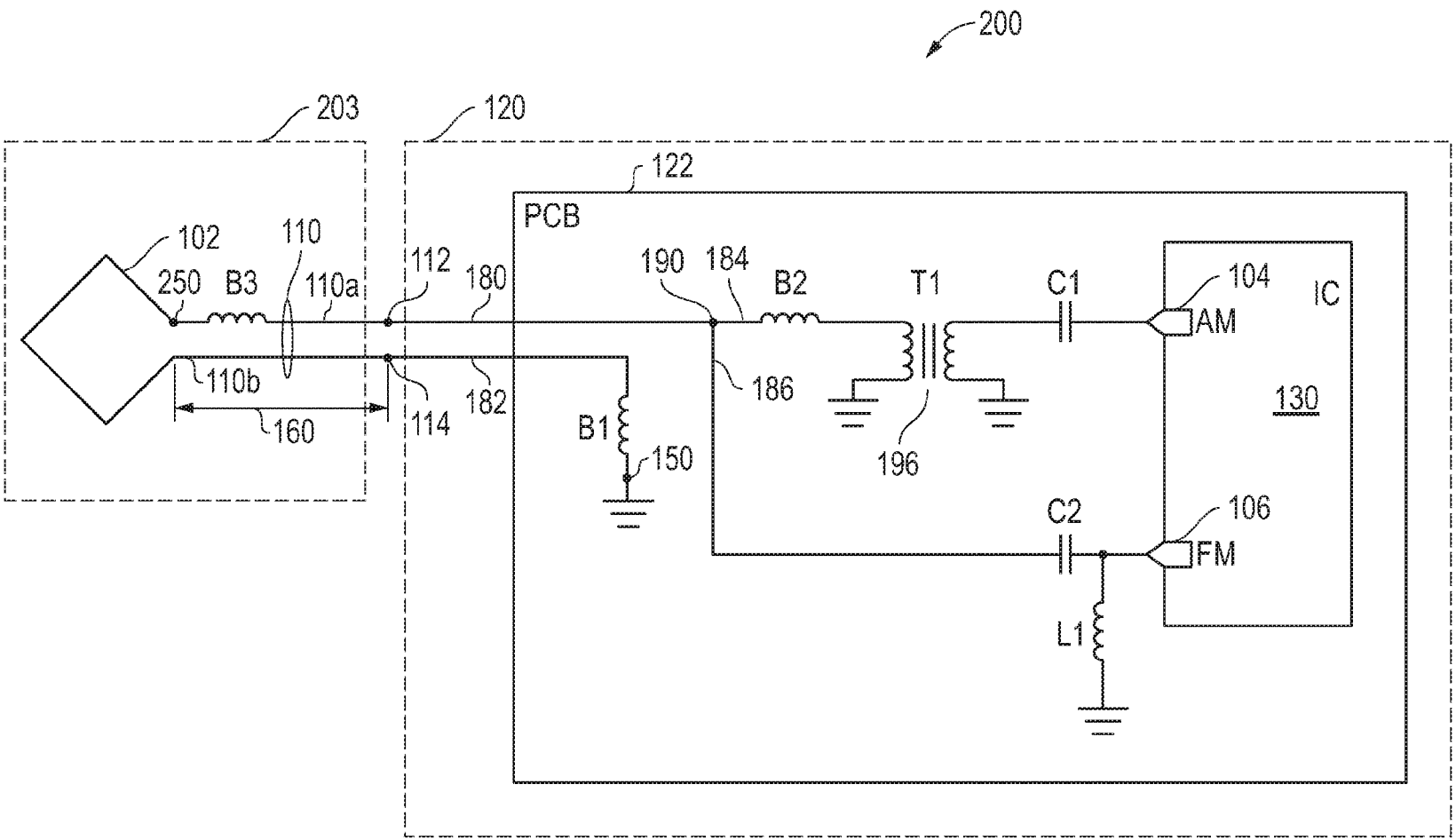
FIG. 2 illustrates a shared AM/FM loop antenna radio receiver system according to one exemplary embodiment.

FIG. 2 illustrates another alternative exemplary embodiment of a shared AM/FM loop antenna radio receiver system 200 which may be implemented to provide further improved FM reception performance. As shown, system 200 is configured in similar manner to system 170 of FIG. 1B, with the exception that an additional FM blocker element B3 is provided as part of loop antenna assembly 203 in a position adjacent a node 250 at one end of the air loops of air loop antenna element 102, i.e., coupled between the actual air loops or turns of antenna 102 and the extension connector segment 110*a* that couples air loop antenna element 102 to antenna connection point 112. FM blocker element B3 may be selected from the same types of circuit components previously described as being suitable for use as FM blocker elements B1 and B2, and in one exemplary embodiment FM blocker B3 may be included as part of an integrated antenna assembly 203 that is separable from AM/FM radio device 120 at external connection points 112/114, and that includes air loop antenna element 102, FM blocker B3, and antenna extension connectors 110. In the embodiment of FIG. 2, FM blocker element B3 may be so placed to block or substantially block relatively higher frequency FM signals received by antenna extension connector 110*a* from entering the loops or turns of air loop antenna element 102, where additional FM signal loss may occur despite the presence of FM blocker elements B1 and B2 due to parasitic capacitance in the air loops of antenna 102. As shown, even with the presence of FM blocker B3, FM blocker element B1 may nonetheless still be optionally provided adjacent ground node 150 to block any FM signal loss that may occur due to capacitance effects between antenna extension connector segments 110*a* and 110*b* of a twisted pair 110.

FIGS. 1A, 1B and 2 illustrate embodiments of a shared AM/FM loop antenna radio receiver systems in which a transformer (T1) 196 is included within AM/FM radio device 120. However, it will be understood that a shared loop antenna system may be alternatively configured to operate with an integrated air loop antenna and transformer antenna assembly, e.g., such as described in U.S. patent application Ser. No. 12/313,087 filed Nov. 17, 2008 and entitled "INTEGRATED AIR LOOP ANTENNA AND TRANSFORMER ANTENNA ASSEMBLY" by Hu et al., which is incorporated herein by reference in its entirety.

Figure 3A:
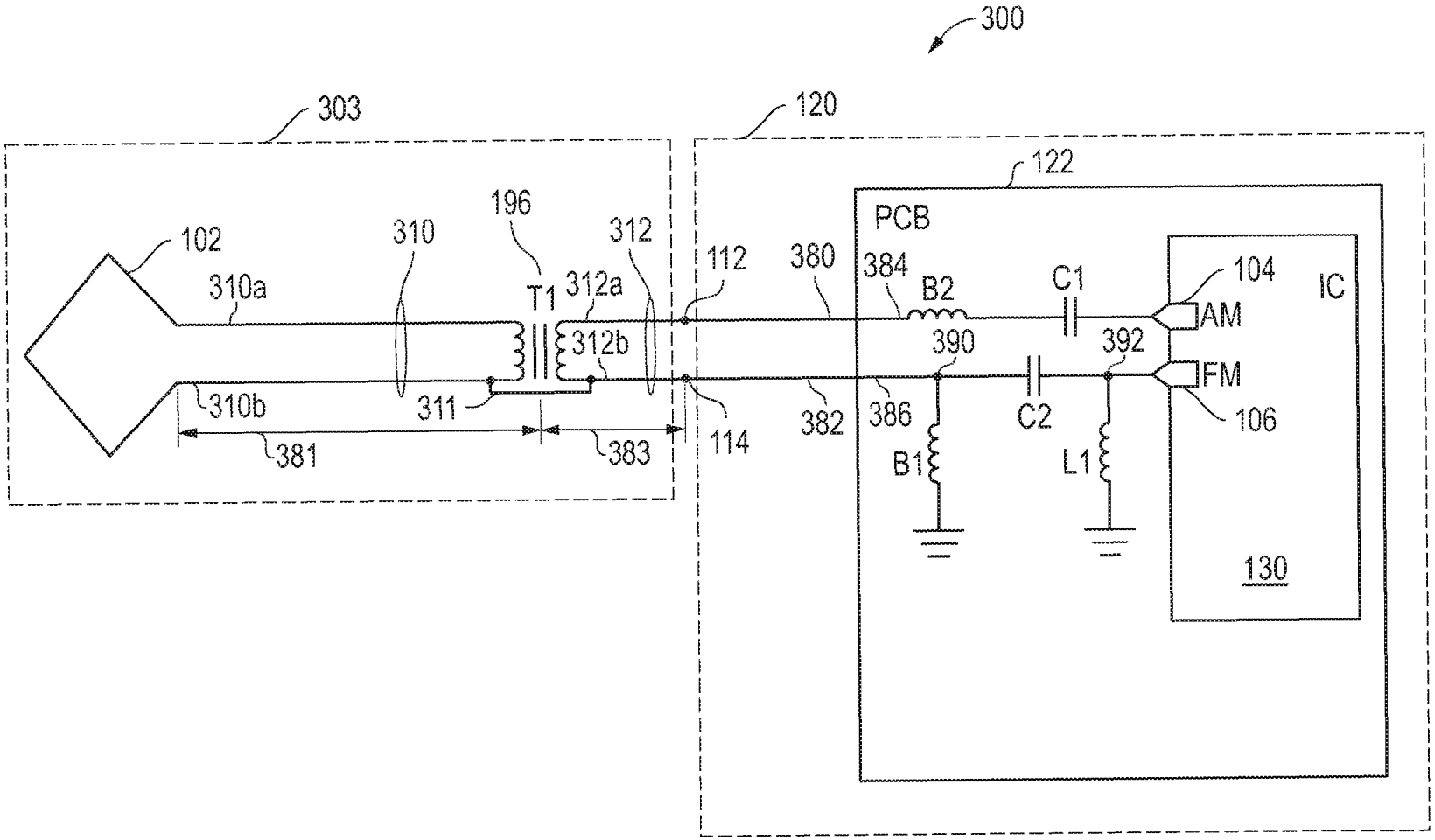
FIG. 3A illustrates a shared AM/FM loop antenna radio receiver system according to one exemplary embodiment.

For example, FIG. 3A shows an exemplary embodiment of a shared AM/FM loop antenna radio receiver system 300 in which shared AM/FM air loop antenna element 102, extension connectors 110, and transformer (T1) 196 are provided together as part of an integrated antenna assembly 303. In this embodiment, transformer (T1) 196 is moved from the PCB 122 to the integrated antenna assembly 303 which includes the air loop antenna element 102. Integrated shared AM/FM air loop antenna assembly 303 includes dual antenna connector segments 310*a* and 310*b* that each extend from air loop antenna element 102 to transformer (T1) 196, and dual antenna connectors 312*a* and 312*b* that each extend from transformer (T1) 196 to removably couple to AM/FM radio device 120 at external connection points 112 and 114 as shown. In this exemplary embodiment, conductive segment 311 is provided as shown to couple a terminal on the primary side of transformer (T1) 196 to the respective terminal on the secondary side of transformer (T1) 196 for the received FM signal path. In the embodiment of FIG. 3A, at least either one or both of extension connector segments 310*a* and 310*b* may be configured to function as an FM antenna element. In one embodiment, the length 381 of each of antenna extension connectors 310 may be from about 0.75 meters to about 1.5 or to about 1.75 meters in length, although any other conductor segment length may be employed that is suitable for receiving FM broadcast channels as described elsewhere herein.

Still referring to FIG. 3A, length 383 of antenna connectors 312*a* and 312*b* may vary as needed, but in one embodiment, it may be desirable that transformer (T1) 196 not be located too far away from PCB 122 such that the parasitic capacitance of the wires from the transformer to PCB 122 becomes so great as to degrade the performance of the tuner on the radio IC 130. For example, in one exemplary embodiment integrated antenna assembly 303 may be configured to place transformer (T1) 196 at a connector length 383 of from about 10 cm to 20 cm from external antenna connection points 112 and 114 of radio device 120 and/or to place transformer (T1) 196 at a conductor length of from about 10 cm to 20 cm from PCB 122. However, it is possible in other embodiments that transformer (T1) 196 may be positioned closer or further away from external antenna connection points 112 and 114 of radio device 120. For example, in one embodiment transformer (T1) 196 may be positioned such that an FM antenna segment (e.g., antenna connectors 312*a* and 312*b* having length of from about 0.75 meter to about 1.5 meters) is provided between transformer (T1) 196 and external antenna connection points 112 and 114 of radio device 120. It also possible that selected lengths of one or both connectors 310 may be combined with one or both connectors 312 to together function as an FM antenna segment, i.e., to form an operative FM antenna segment that includes at least a portion of the length of connector/s 310 and the length of connector/s 312.

In the embodiment of FIG. 3A, antenna connection points 112 and 114 are shown removably coupled to AM signal path 380 and and shared FM signal/ground path 382 of radio device 120, respectively. AM signal paths 380 and 382 are in turn coupled to provide received RF signals to AM signal path 384 and shared FM signal/ground path 386 of PCB 122, respectively, which are each provided on PCB 122 of system 300 as shown. In particular, AM signal path 384 is coupled to AM signal input pin 104 of integrated circuit (IC) 130, and shared FM signal/ground path 386 is coupled to ground and to FM signal input pin 106 of IC 130. As shown, AM signal path 384 includes FM blocker B2 in series with AC coupling capacitor C1 provided on PCB 122 between connection point 112 and AM signal input pin 104. Shared FM signal/ground path 386 includes AC coupling capacitor C2 that is coupled between connection point 114 and FM signal input pin 106, and a FM blocker B1 that is coupled between ground and a node 390 that is positioned between AC coupling capacitor C2 and connection point 114. An inductor L1 is coupled between ground and a node 392 that is positioned between AC coupling capacitor C2 and FM signal input pin 106.

It will be understood that the values and functions of individual components B1, B2, C1, C2 and L1 of FIG. 3A may be the same or substantially similar to that described for these components in relation to the embodiments of FIGS. 1 and 2. In this regard, FM blockers B1 and B2 may be provided to selectively block dissipation of FM signals in a manner that allows both antenna extension connector segments 310 and 312 to function as a FM antenna while in the same configuration that allows air loop antenna element 102 to function as an AM antenna. In this regard, FM blocker B2 may be provided as shown to block or substantially block the received FM signals from AM signal input pin 104, and FM blocker B1 may be provided as shown to block or substantially block of the received FM signals from ground while providing a DC ground path for system operations. Further, it will be understood that an integrated shared AM/FM antenna assembly 303 may be further provided with an additional FM blocker element B3 in a manner similar to that illustrated in FIG. 2 to block or substantially block relatively higher frequency FM signals received by antenna extension connector segment 310*b* from entering the loops or turns of air loop antenna element 102, where additional FM signal loss may occur.

An integrated shared AM/FM air loop antenna and transformer assembly 303 of this exemplary embodiment may be employed, for example, to implement air loop antenna applications in smaller devices that have AM/FM functions, e.g., such as MP3 players, cell phones and/or other devices where a reduced size is desired. By removing the transformer (T1) 196 out from the radio device 120 and having it integrated with the air loop antenna element 102, it is possible to have these small devices include AM/FM functionality by including a simple two-point AM/FM antenna connection 112/114. In this way, these devices may then be used as good radio devices for AM/FM reception with a shared AM/FM integrated air loop antenna and transformer assembly 303 plugged into the device 120.

Figure 3B:
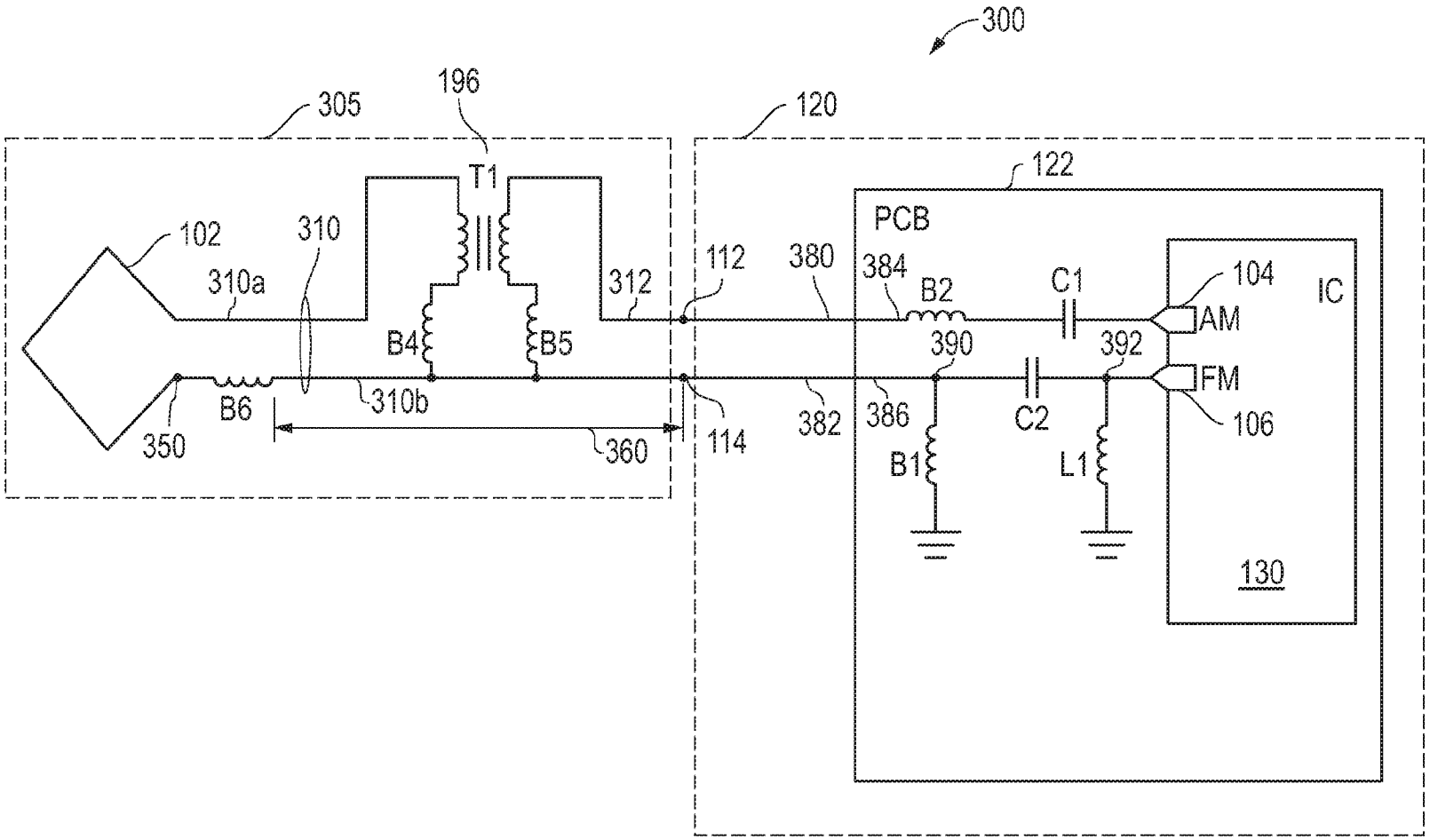
FIG. 3B illustrates a shared AM/FM loop antenna radio receiver system according to one exemplary embodiment.
Figure 3C:
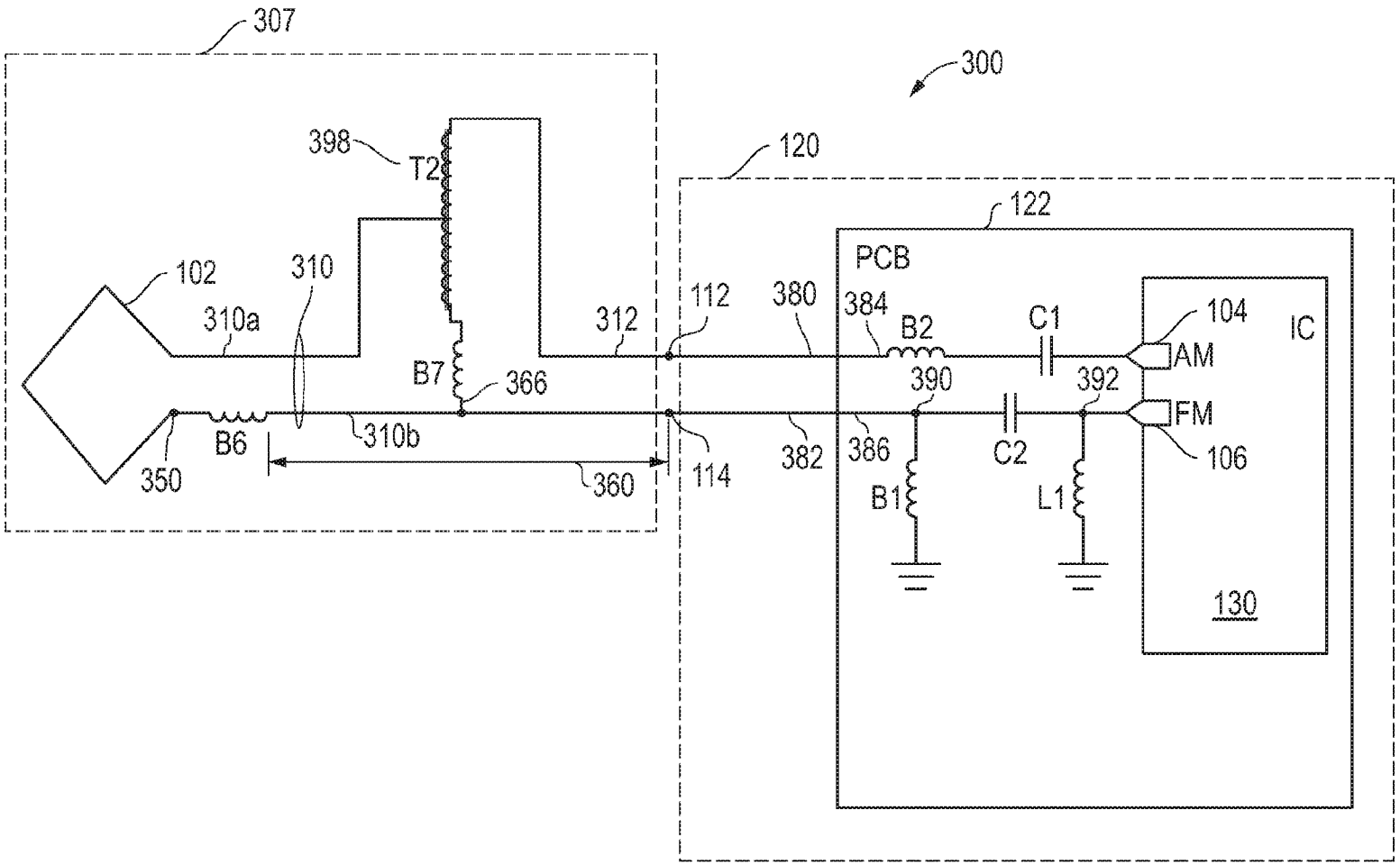
FIG. 3C illustrates a shared AM/FM loop antenna radio receiver system according to one exemplary embodiment.

FIGS. 3B and 3C illustrate other exemplary embodiments of a shared AM/FM loop antenna radio receiver system 300 which include an integrated antenna assembly that may be employed in a manner similar to integrated antenna and transformer assembly 303. The embodiment of FIG. 3B is similar to the embodiment of FIG. 3A, except that one of the primary terminals and one of the secondary terminals of transformer (T1) 196 are each coupled to extension connector segment 310*b* between air loop antenna element 102 and antenna connection point 114 by a respective FM blocker B4 or B5 to at least partially isolate received FM signals from transformer (T1) 196. It is alternatively possible that the function of FM blockers B4 and B5 may be provided by a common (e.g., single common) FM blocker. In such an alternative embodiment, one of the primary terminals and one of the secondary terminals of transformer (T1) 196 may be coupled together at a common node provided between extension connector segment 310*b* and transformer (T1) 196, e.g., with no FM blockers coupled between the common node and the primary and secondary terminals of transformer (T1) 196. The common node may in turn be coupled to extension connector segment 310*b* by a common FM blocker/s to at least partially isolate received FM signals from transformer (T1) 196.

Still referring to FIGS. 3B and 3C, an additional FM blocker element B6 may be optionally coupled as shown in a position adjacent a node 350 at one end of the air loops of air loop antenna element 102 between the actual air loops or turns of antenna 102 and the extension connector segment 310*b* that couples air loop antenna element 102 to antenna connection point 114 to at least partially isolate the loops or turns of air loop antenna element 102 from received FM signals. In the embodiment of FIG. 3B, the length 360 of extension connector segment 310*b* functions as an FM antenna element, e.g., being from about 0.75 meters to about 1.5 or to about 1.75 meters in length, or any other length that is suitable for receiving FM broadcast channels. It will be understood that the values and functions of individual components B1, B2, C1, C2 and L1 of FIG. 3B may be the same or substantially similar to that described for these components in relation to the embodiments of FIGS. 1 and 2.

The exemplary embodiment of FIG. 3C employs an autotransformer (T2) 398 that is integrated with air loop antenna 102 as shown. In this embodiment, one terminal of autotransformer (T2) 398 is coupled to extension connector segment 310*b* between air loop antenna element 102 and antenna connection point 114 by a FM blocker B7 to at least partially isolate received FM signals from autotransformer (T2) 398. As with the embodiment of FIG. 3B, an additional FM blocker element B6 may be optionally coupled as shown in a position adjacent a node 350 at one end of the air loops of air loop antenna element 102 between the actual air loops or turns of antenna 102 and the extension connector segment 310*b* that couples air loop antenna element 102 to antenna connection point 114 to at least partially isolate the loops or turns of air loop antenna element 102 from received FM signals. In the embodiment of FIG. 3C, the length 360 of extension connector segment 310*b* functions as an FM antenna element, e.g., being from about 0.75 meters to about 1.5 or to about 1.75 meters in length, or any other length that is suitable for receiving FM broadcast channels. It will be understood that the values and functions of individual components B1, B2, C1, C2 and L1 of FIG. 3C may be the same or substantially similar to that described for these components in relation to the embodiments of FIGS. 1 and 2.

Figure 4:
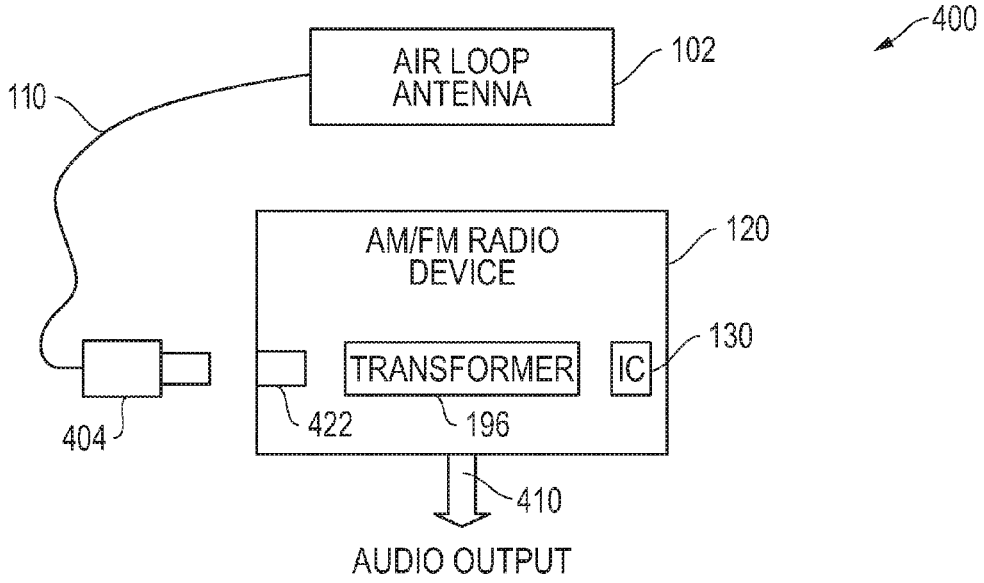
FIG. 4 illustrates a shared AM/FM loop antenna radio receiver system according to one exemplary embodiment.

FIG. 4 is a block diagram for one embodiment of a shared AM/FM loop antenna radio receiver system 400 including an AM/FM radio device 120 (e.g., home theater system, boom box, miniature high fidelity system, etc.) and an air loop antenna element 102 for AM signal reception. As shown, antenna extension connectors 110 extend from air loop antenna element 102 to the radio device 120. As described herein, both of dual antenna extension connector segments 110 form an antenna for FM signal reception. The antenna extension connectors 110 have a connection 404 that removably couples to connection 422 on the radio device 120. As shown, radio device 120 may be provided with a single shared connection 422 (e.g., single antenna jack) for receiving both AM and FM signals from the single shared AM/FM air loop antenna element 102, rather than requiring separate AM and FM antenna jacks for receiving AM and FM signals from separate AM and FM antennas. The radio device 120 may be further configured to provide audio output 410 in a desired format, such as digital and/or analog audio information. For example, the audio output 410 may be an output for one or more speakers, headphones, etc. as desired.

Figure 5:
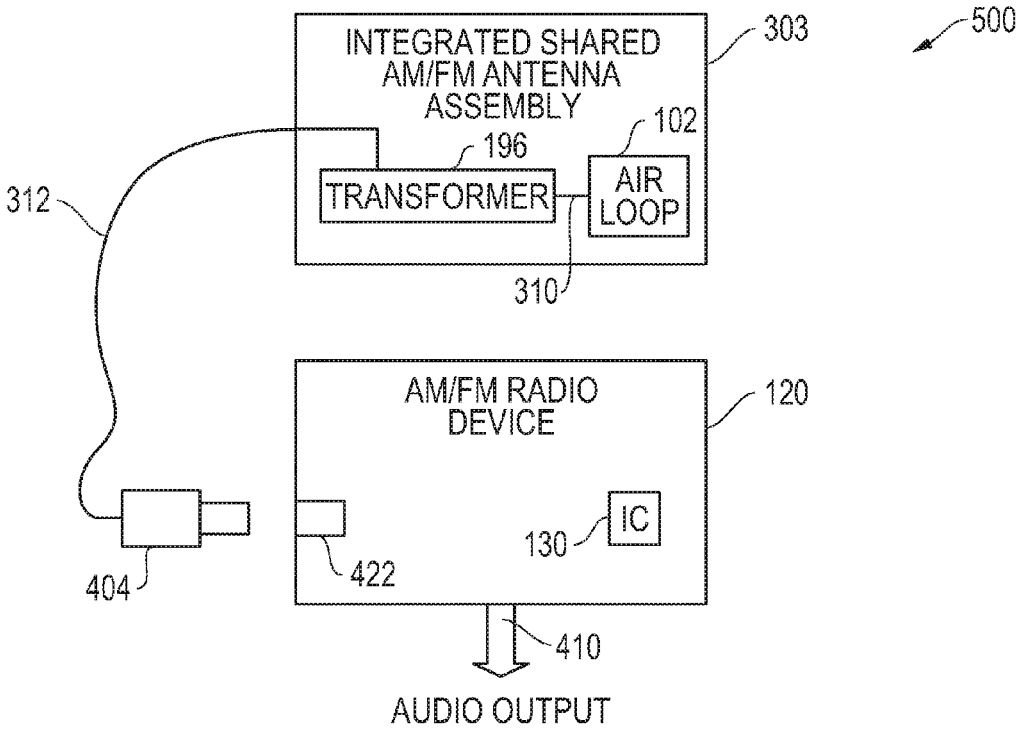
FIG. 5 illustrates a shared AM/FM loop antenna radio receiver system according to one exemplary embodiment.

FIG. 5 is a block diagram for one embodiment of a shared AM/FM loop antenna radio receiver system 500 including an AM/FM radio device 120 and a shared AM/FM integrated antenna assembly 303. As described herein, the integrated antenna assembly 303 includes a transformer 196 and an air loop antenna element 102 for AM signal reception. As shown, dual antenna connectors 312 extend from shared AM/FM integrated antenna assembly 303 to the radio device 120. In this embodiment, the antenna connectors 312 have a connection 404 that removably couples to connection 422 (e.g., single antenna jack) on the radio device 120. The radio device 120 may be further configured to provide audio output 410 as described for the embodiment of FIG. 4. As described herein, dual antenna extension conductors 310 are provided between air loop antenna element 102 and transformer 196, and both segments of dual extension conductors 310 and 312 form an antenna for FM signal reception. It will be understood that the embodiment of FIG. 5 may alternatively be implemented, for example, using a shared AM/FM integrated antenna assembly 305 or 307 in place of AM/FM integrated antenna assembly 303.

The shared AM/FM integrated antenna assembly embodiments described herein may be used to address AM/FM reception for any desired application where there is strong close-by AM and/or FM interference. For example, in addition to the devices discussed above, the integrated antenna assemblies may also be used with USB (Universal Serial Bus) radio devices, which are devices that may have AM/FM radio circuitry and USB connectors for insertion into USB ports associated with electronic devices. As an example, USB radio devices are often plugged into personal computers that are well known for their strong interference to the reception of channels within AM broadcast bands. In one exemplary embodiment, the integrated antenna assemblies described herein make it possible to build a small, flash-drive size USB AM/FM radio with an air loop and transformer assembly interface. The user may then attach the shared AM/FM integrated air loop antenna and transformer assembly to the USB device if AM/FM reception is desired for the electronic device to which the USB connector is connected.

Figure 6:
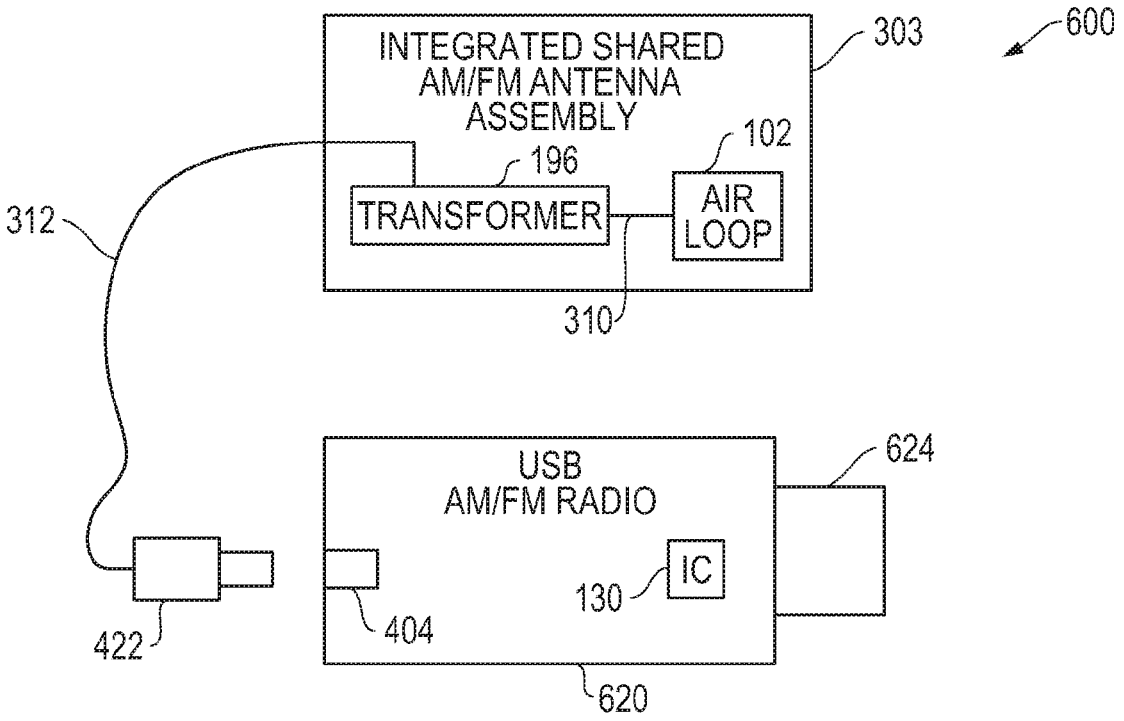
FIG. 6 illustrates a shared AM/FM loop antenna radio receiver system according to one exemplary embodiment.

FIG. 6 is a block diagram for a shared AM/FM loop antenna radio receiver system 600 including a USB (Universal Serial Bus) radio 620 and and a shared AM/FM integrated antenna assembly 303. Again, the integrated antenna assembly 303 includes a transformer 196 and an air loop antenna element 102 for AM signal reception, and dual antenna extension conductors 310 are provided between air loop antenna element 102 and transformer 196 with one or both segments of dual extension conductors 310 forming an antenna for FM signal reception. Dual antenna connectors 312 extend from shared AM/FM integrated antenna assembly 303 to the USB radio device 620, and the antenna connectors 312 have a connection 404 that removably couples to connection 422 (e.g., single antenna jack) on the USB radio device 620. As shown, the USB radio 620 may also have a USB connector 624 that may be coupled to a USB port on another device, such as a USB port associated with a personal computer. The device to which the USB radio 620 is connected may be further configured to provide an audio output in a desired format, such as digital and/or analog audio information. It will be understood that the embodiment of FIG. 6 may alternatively be implemented, for example, using a shared AM/FM integrated antenna assembly 305 or 307 in place of AM/FM integrated antenna assembly 303.

Further modifications and alternative embodiments of this invention will be apparent to those skilled in the art in view of this description. It will be recognized, therefore, that the present invention is not limited by these example arrangements. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the implementations and architectures. For example, equivalent elements may be substituted for those illustrated and described herein, and certain features of the invention may be utilized independently of the use of other features, all as would be apparent to one skilled in the art after having the benefit of this description of the invention.

What is claimed is:

1. Shared AM/FM antenna circuitry configured for coupling to radio circuitry, comprising:

an air loop antenna element formed between first and second antenna element nodes, the air loop antenna element being configured to receive AM channels within an AM broadcast band;

a first conductor segment coupled to the first node of the air loop antenna element with the first node being between the air loop antenna element and the first conductor segment; and a second conductor segment coupled to the second node of the air loop antenna element with the second node being between the air loop antenna element and the second conductor segment;

at least one of the first and second conductor segments being configured to receive FM channels within an FM broadcast band;

at least one of the first and second conductor segments being coupled between the first or second node of the air loop antenna element and an AM signal path, the AM signal path being configured for coupling at a third node to provide the received AM broadcast channels to an AM signal input of the radio circuitry;

at least one of the first and second conductor segments being coupled between the first or second node of the air loop antenna element and a FM signal path, the FM signal path being configured for coupling at a fourth node to provide the received FM broadcast channels to an FM signal input of the radio circuitry;

the AM signal path being further configured to at least partially block the received FM broadcast band channels and to at least partially pass the received AM broadcast band channels to the AM signal input of the radio circuitry; and the FM signal path being further configured to at least partially pass the received FM broadcast band channels to the FM signal input of the radio circuitry.

2. The circuitry of claim 1, the first conductor segment extending from the first node of the air loop antenna element, the first conductor segment being coupled to the AM signal path and the FM signal path; the second conductor extending from the second node of the air loop antenna element, the circuitry further comprising a ground path coupled to the second conductor segment, the ground path being configured to at to at least partially block the received FM broadcast band channels from ground.

3. The circuitry of claim 2, further comprising:

at least one first FM blocker element provided in the AM signal path, the first FM blocker element being configured to substantially pass the received AM broadcast band channels through the AM signal path and to substantially block the received FM broadcast band channels from passing through the AM signal path; and at least one second FM blocker element provided in the ground path, the second FM blocker element being configured to substantially block the received FM broadcast band channels from passing through the ground path;

each of the first and second FM blocker elements being a low pass, band pass, or band reject filter.

4. The circuitry of claim 3, wherein the first and second FM blocker elements comprise ferrite beads.

5. The circuitry of claim 3, further comprising at least one third FM blocker element coupled between the first node and the first conductor segment, the third FM blocker element being configured to substantially pass the received AM broadcast band channels from the air loop antenna element to the first conductor segment, and to substantially block the received FM broadcast band channels from passing from the first conductor segment to the air loop antenna element; the third FM blocker elements being a low pass, band pass, or band reject filter.

6. The circuitry of claim 3, further comprising a transformer coupled within the AM signal path between the first FM blocker element and the third node.

7. The circuitry of claim 1, the circuitry being configured as an integrated antenna assembly that further comprises a transformer, the transformer being coupled between the first conductor segment and the AM signal path, the transformer also being coupled between the second conductor segment and the FM signal path.

8. The circuitry of claim 7, further comprising a ground path coupled to the second conductor segment, the ground path being configured to at least partially block the received FM broadcast band channels from ground, and the circuitry further comprising:

at least one first FM blocker element provided in the AM signal path, the first FM blocker element being configured to substantially pass the received AM broadcast band channels through the AM signal path and to substantially block the received FM broadcast band channels from passing through the AM signal path; and at least one second FM blocker element provided in the ground path, the second FM blocker being configured to substantially block the received FM broadcast band channels from passing through the ground path;

each of the first and second FM blocker elements being a low pass, band pass, or band reject filter.

9. The circuitry of claim 1, the circuitry being configured as an integrated antenna assembly that further comprises a transformer, the transformer being coupled between the first conductor segment and the AM signal path and the transformer not being coupled between the second conductor segment and the FM signal path.

10. The circuitry of claim 1, the AM broadcast band being at least one of from about 520 KHz to about 1710 KHz, from about 148.5 KHz to about 283.5 KHz, or a combination thereof; and the FM broadcast band being at least one of from about 87.5 MHz to about 108 MHz, from about 76 MHz to about 90 MHz, from about 65 MHz to about 74.5 MHz, or a combination thereof.

11. The circuitry of claim 1, the first conductor segment having a length between about 0.75 meters and about 1.5 meters.

12. The circuitry of claim 1, the first conductor segment and the second conductor segment being configured as twisted pair wiring.

13. An AM/FM radio receiver system, comprising:

a radio device, the radio device comprising:

antenna connections,

AM/FM radio circuitry including tuner circuitry, the tuner circuitry having an AM signal input and a FM signal input, the AM signal input configured to receive AM broadcast channels and the FM signal input configured to receive receive FM broadcast channels;

an AM signal path coupled between at least one of the antenna connections and the AM signal input, and an FM signal path coupled between at least one of the antenna connections and the FM signal input; and a shared AM/FM loop antenna coupled to the antenna connections of the radio device, the shared AM/FM loop antenna comprising:

an air loop antenna element formed between first and second antenna element nodes, the air loop antenna element being configured to receive AM channels within an AM broadcast band, a first conductor segment coupled to the first node of the air loop antenna element with the first node being between the air loop antenna element and the first conductor segment, and a second conductor segment coupled to the second node of the air loop antenna element with the second node being between the air loop antenna element and the second conductor segment, at least one of the first and second conductor segments being configured to receive FM channels within an FM broadcast band; and at least one of the first and second conductor segments being coupled between the first or second node of the air loop antenna element and the AM signal path by one of the radio device antenna connections;

at least one of the first and second conductor segments being coupled between the first or second node of the air loop antenna element and the FM signal path by one of the radio device antenna connections;

the AM signal path being further configured to at least partially block the received FM broadcast band channels and to at least partially pass the received AM broadcast band channels to the AM signal input of the radio circuitry; and the FM signal path being further configured to at least partially pass the received FM broadcast band channels to the FM signal input of the radio circuitry.

14. The receiver system of claim 13, the first conductor segment extending from the first node of the air loop antenna element, the first conductor segment being coupled to the AM signal path and the FM signal path by one of the radio device antenna connections; the second conductor extending from the second node of the air loop antenna element; and the radio device further comprising:

a ground path coupled to the second conductor segment by one of the radio device antenna connections;

at least one first FM blocker element provided in the AM signal path, the first FM blocker element being configured to substantially pass the received AM broadcast band channels to the AM signal input through the AM signal path and to substantially block the received FM broadcast band channels from passing through the AM signal path to the AM signal input; and at least one second FM blocker element provided in the ground path, the second FM blocker being configured to substantially block the received FM broadcast band channels from passing to ground through the ground path;

each of the first and second FM blocker elements being a low pass, band pass, or band reject filter.

15. The receiver system of claim 14, wherein the first and second FM blocker elements comprise ferrite beads.

16. The receiver system of claim 15, further comprising at least one third FM blocker element coupled between the first node and the first conductor segment, the third FM blocker element being configured to substantially pass the received AM broadcast band channels from the air loop antenna element to the first conductor segment, and to substantially block the received FM broadcast band channels from passing from the first conductor segment to the air loop antenna element; the third FM blocker element being a low pass, band pass, or band reject filter.

17. The receiver system of claim 15, further comprising a transformer coupled within the AM signal path between the first FM blocker element and the third node.

18. The receiver system of claim 17, the shared AM/FM loop antenna being an external antenna; the radio device antenna connections being external antenna connections; the radio circuitry being a radio integrated circuit; the radio device further comprising a printed circuit board positioned within the radio device; and the radio integrated circuit, AM signal path, FM signal path, ground path and transformer each being on the printed circuit board.

19. The receiver system of claim 13, the shared AM/FM loop antenna being configured as an external integrated antenna assembly that further comprises a transformer; the radio device antenna connections being external antenna connections; the radio circuitry being a radio integrated circuit; the radio device further comprising a printed circuit board positioned within the radio device; the radio integrated circuit, AM signal path and FM signal path each being on the printed circuit board; and the transformer being coupled between each of the first and second conductor segments and the external antenna connections.

20. The receiver system of claim 13, the AM broadcast band being at least one of from about 520 KHz to about 1710 KHz, from about 148.5 KHz to about 283.5 KHz, or a combination thereof; and the FM broadcast band being at least one of from about 87.5 MHz to about 108 MHz, from about 76 MHz to about 90 MHz, from about 65 MHz to about 74.5 MHz, or a combination thereof.

21. The receiver system of claim 13, the first conductor segment having a length between about 0.75 meters and about 1.5 meters.

22. A method for receiving AM and FM radio frequency (RF) signals with an air loop antenna, comprising:

providing shared AM/FM antenna circuitry, comprising:

an air loop antenna element formed between first and second antenna element nodes, a first conductor segment coupled to the first node of the air loop antenna element with the first node being between the air loop antenna element and the first conductor segment, and a second conductor segment coupled to the second node of the air loop antenna element with the second node being between the air loop antenna element and the second conductor segment;

receiving AM broadcast band signals within the air loop antenna element and coupling the received AM signals through at least one of the first and second conductor segments to an AM signal path of a radio device;

receiving FM broadcast band signals within at least one of the first and second conductor segments and coupling the received FM signals to an FM signal path of a radio device;

at least partially passing the received AM broadcast band channels through the AM signal path to an AM signal input of radio circuitry, and at least partially blocking the received FM signals in the AM signal path from the AM signal input;

at least partially passing the received FM signals through the FM signal path to an FM signal input of the radio circuitry; and tuning the received AM and FM signals in the radio circuitry.

23. The method of claim 22, further comprising at least partially blocking the received FM broadcast band channels from ground in a ground path of the radio device.

24. The method of claim 23, further comprising:

using at least one first FM blocker element to at least partially block the received FM signals in the AM signal path from the AM signal input; and using at least one second FM blocker element to at least partially block the received FM broadcast band channels from ground in a ground path of the radio device;

where each of the first and second FM blocker elements is a low pass, band pass, or band reject filter.

25. The method of claim 24, the first and second FM blocker elements comprising ferrite beads.

26. The method of claim 22, the AM broadcast band being at least one of from about 520 KHz to about 1710 KHz, from about 148.5 KHz to about 283.5 KHz, or a combination thereof; and the FM broadcast band being at least one of from about 87.5 MHz to about 108 MHz, from about 76 MHz to about 90 MHz, from about 65 MHz to about 74.5 MHz, or a combination thereof.

* * * * *